US011274877B2

(12) United States Patent
Wang et al.

(10) Patent No.: US 11,274,877 B2
(45) Date of Patent: Mar. 15, 2022

(54) OXYGEN-CONTROL FRESHNESS PRESERVATION REFRIGERATOR

(71) Applicant: QINGDAO HAIER CO., LTD., Qingdao (CN)

(72) Inventors: Lei Wang, Qingdao (CN); Bo Jiang, Qingdao (CN); Jianquan Chen, Qingdao (CN); Chun Yang, Qingdao (CN); Liyan Wang, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 199 days.

(21) Appl. No.: 16/754,121

(22) PCT Filed: Nov. 15, 2018

(86) PCT No.: PCT/CN2018/115565
§ 371 (c)(1),
(2) Date: Apr. 6, 2020

(87) PCT Pub. No.: WO2019/242214
PCT Pub. Date: Dec. 26, 2019

(65) Prior Publication Data

US 2020/0284501 A1 Sep. 10, 2020

(30) Foreign Application Priority Data

Jun. 19, 2018 (CN) ..... 201810629136.7

(51) Int. Cl.
*F25D 23/12* (2006.01)
*F25D 11/02* (2006.01)

(52) U.S. Cl.
CPC ..... *F25D 23/12* (2013.01); *F25D 11/02* (2013.01)

(58) Field of Classification Search
CPC .... F25D 11/02; F25D 17/042; F25D 2201/30; F25D 2317/041; F25D 2317/061; F25D 23/069; F25D 23/12; F25B 2500/12
See application file for complete search history.

(56) References Cited

U.S. PATENT DOCUMENTS 5,127,235 A * 7/1992 Nakanishi ..... G10K 11/17817 62/115
6,512,831 B1 * 1/2003 Herreman ..... F25D 23/00 381/71.3

(Continued)

FOREIGN PATENT DOCUMENTS

CN 106593818 A 4/2017
CN 106766565 A 5/2017
CN 108759243 A 11/2018

*Primary Examiner* — Filip Zec
(74) *Attorney, Agent, or Firm* — Cheng-Ju Chiang

(57) ABSTRACT

Disclosed is an oxygen-control freshness preservation refrigerator, comprising a cabinet with a refrigerating compartment and a freezing compartment. A partition plate for separating the refrigerating compartment from the freezing compartment is arranged in the cabinet. The refrigerator further has a freshness preservation compartment arranged inside the refrigerating compartment and an oxygen control device for reducing the oxygen content inside the freshness preservation compartment, the oxygen control device comprises a gas-regulating membrane assembly and a gas extraction assembly. The gas-regulating membrane assembly has at least one gas-regulating membrane for selective gas permeation. The gas extraction assembly has a gas extraction pump arranged in the partition plate; and the gas extraction pump is provided with a gas intake pipe in communication with a gas discharge side of the gas-regulating membrane, and a gas discharge pipe for discharging gas from the gas discharge side of the gas-regulating membrane.

10 Claims, 5 Drawing Sheets

(56) References Cited

U.S. PATENT DOCUMENTS

| | | | | |
|---|---|---|---|---|
| 7,114,345 | B2 * | 10/2006 | Kim | F25D 23/003 62/296 |
| 8,065,885 | B2 * | 11/2011 | Wang | F25D 17/042 62/78 |
| 2007/0169504 | A1 * | 7/2007 | Vinocur | F25D 17/045 62/408 |
| 2016/0245555 | A1 * | 8/2016 | Tanaka | F25D 17/042 |
| 2017/0184334 | A1 * | 6/2017 | Boehringer | F24F 13/24 |
| 2018/0172335 | A1 * | 6/2018 | Avhale | F25D 23/003 |

* cited by examiner

OXYGEN-CONTROL FRESHNESS PRESERVATION REFRIGERATOR

The present application is a 35 U.S.C. § 371 National Phase conversion of International (PCT) Patent Application No. PCT/CN2018/115565, filed on Nov. 15, 2018, which claims priority to Chinese Patent Application No. 201810629136.7, filed to the Chinese Patent Office on Jun. 19, 2018 and titled "Oxygen-Control Freshness Preservation Refrigerator", the content of which is incorporated herein by reference in its entirety. The PCT International Patent Application was filed and published in Chinese.

TECHNICAL FIELD

The present invention relates to the field of household appliances, and in particular, to a refrigerator with an oxygen-control freshness preservation function.

BACKGROUND

A refrigerator facilitates home lives greatly due to a low-temperature preservation function. However, with an improvement of the quality of life, a consumer has an increasing requirement for freshness preservation of stored foods, and a conventional refrigerator has been unable to meet an increasing demand of a user. Based on this, the following solution has been explored in the industry. A freshness preservation compartment is provided in a cabinet of the refrigerator, and a freshness preservation effect of the freshness preservation compartment is optimized by vacuuming the freshness preservation compartment or reducing an oxygen concentration therein. Based on a design requirement of this function, usually, the refrigerator is required to be provided with a gas extraction pump for sucking gas in the freshness preservation compartment to facilitate reduction of an oxygen content of air therein. In an existing design, usually, the gas extraction pump is provided in a compressor compartment having a compressor. However, such a design has the following problems.

1. When the refrigerator runs, a temperature which is too high in the compressor compartment may affect an efficient operation of the gas extraction pump and even a service life thereof, such that a target oxygen content is unable to be reached in the freshness preservation compartment, which reduces the freshness preservation effect of the freshness preservation compartment.

2. In the compressor compartment, a simultaneous operation of the gas extraction pump and the compressor is prone to generate a resonance, which increases a noise of the refrigerator and does not meet a silent requirement of a user for refrigerators.

In view of this, it is necessary to provide an improved refrigerator to solve the above-mentioned problems.

SUMMARY

The present invention seeks to solve one of the technical problems in a prior art to at least some extent. In order to achieve the above-mentioned inventive object, the present invention provides a refrigerator with an oxygen-control freshness preservation function, a specific design of which is as follows.

An oxygen-control freshness preservation refrigerator, comprising a cabinet having a refrigerating compartment and a freezing compartment formed therein, the cabinet being provided therein with a partition plate for separating the refrigerating compartment from the freezing compartment, wherein the refrigerator further has a freshness preservation compartment provided in the refrigerating compartment and an oxygen control device for reducing an oxygen content in the freshness preservation compartment, and the oxygen control device comprises a controlled atmosphere membrane assembly and a suction assembly; the controlled atmosphere membrane assembly has at least one controlled atmosphere membrane permeating gas selectively, the controlled atmosphere membrane has an air inflow side coming into contact with air in the freshness preservation compartment and an air outgoing side opposite to the air inflow side, and the controlled atmosphere membrane assembly is configured to enable an oxygen-to-nitrogen content ratio of gas entering the air outgoing side from the air inflow side to be greater than an oxygen-to-nitrogen content ratio of gas in the freshness preservation compartment; the suction assembly has a gas extraction pump provided in the partition plate, and the gas extraction pump has a gas intake pipe communicated with the air outgoing side of the controlled atmosphere membrane and a gas discharge pipe for exhausting the gas at the air outgoing side of the controlled atmosphere membrane.

Further, the cabinet has a compressor compartment formed at a bottom, for mounting a compressor, and the gas discharge pipe extends into the compressor compartment to cool the compressor.

Further, an evaporating pan is provided in the compressor compartment, the refrigerator further has a drainage pipe connected with a refrigerating liner to drain liquid water therein into the evaporating pan, and the gas discharge pipe approaches the drainage pipe from the gas extraction pump and extends into the compressor compartment through the drainage pipe.

Further, wherein an air outlet of the gas discharge pipe extends right above the evaporating pan.

Further, a thermal insulation layer is formed in the partition plate, and the suction assembly is provided in the thermal insulation layer.

Further, the refrigerating compartment is located right above the freezing compartment, the freshness preservation compartment is provided at a bottom of the refrigerating compartment, and the gas extraction pump is provided at a center of the partition plate.

Further, the suction assembly further has an accommodating box mounted at a rear wall of the refrigerating liner and a mounting rack connected with the gas extraction pump and mounted in the accommodating box by a plurality of shock-absorption cushion blocks.

Further, the freshness preservation compartment has a drawer able to slide in and out.

Further, the controlled atmosphere membrane assembly is provided outside a top wall of the freshness preservation compartment, and an opening is provided outside the top wall of the freshness preservation compartment for the air therein to come into contact with an air inflow side of the controlled atmosphere membrane.

Further, the gas intake pipe passes through a rear wall of the refrigerating compartment to connect the gas extraction pump with the controlled atmosphere membrane assembly.

The present invention has the following beneficial effects. A gas extraction pump in a refrigerator is provided in a partition plate and separated from a compressor, which may effectively solve a problem of a running resonance in an existing design and reduce a running noise of the refrigerator; when the refrigerator runs, a low temperature environment may be maintained in the partition plate provided between a freezing compartment and a refrigerating compartment, thus prolonging a service life of the gas extraction pump and optimizing a running performance thereof.

DETAILED DESCRIPTION

The present invention is below described in detail in combination with each embodiment illustrated in drawings. FIGS. 1-6 show a preferable embodiment of the present invention.

Figure 1:
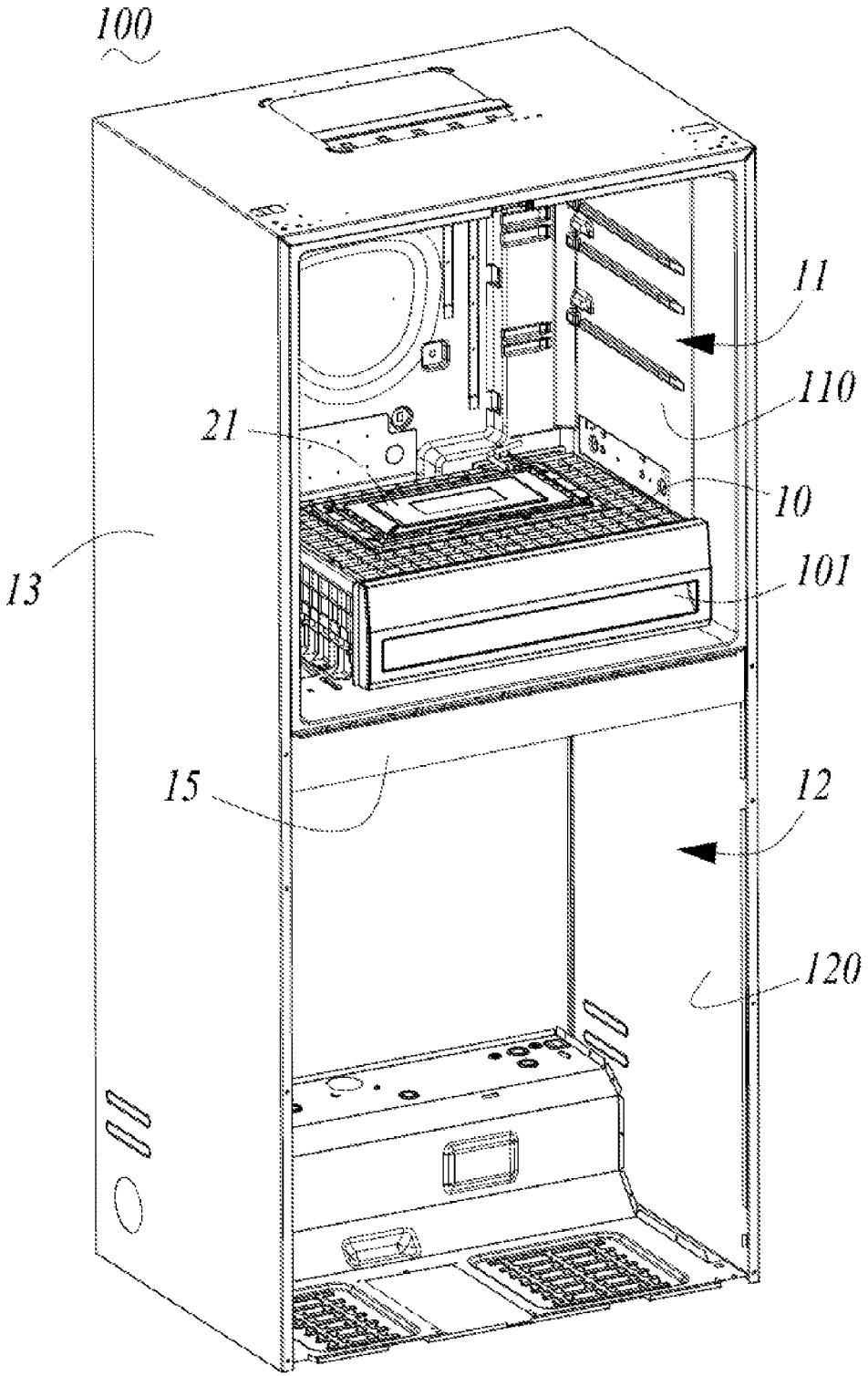
FIG. 1 shows a schematic diagram of a refrigerator according to the present invention at a first angle.
Figure 2:
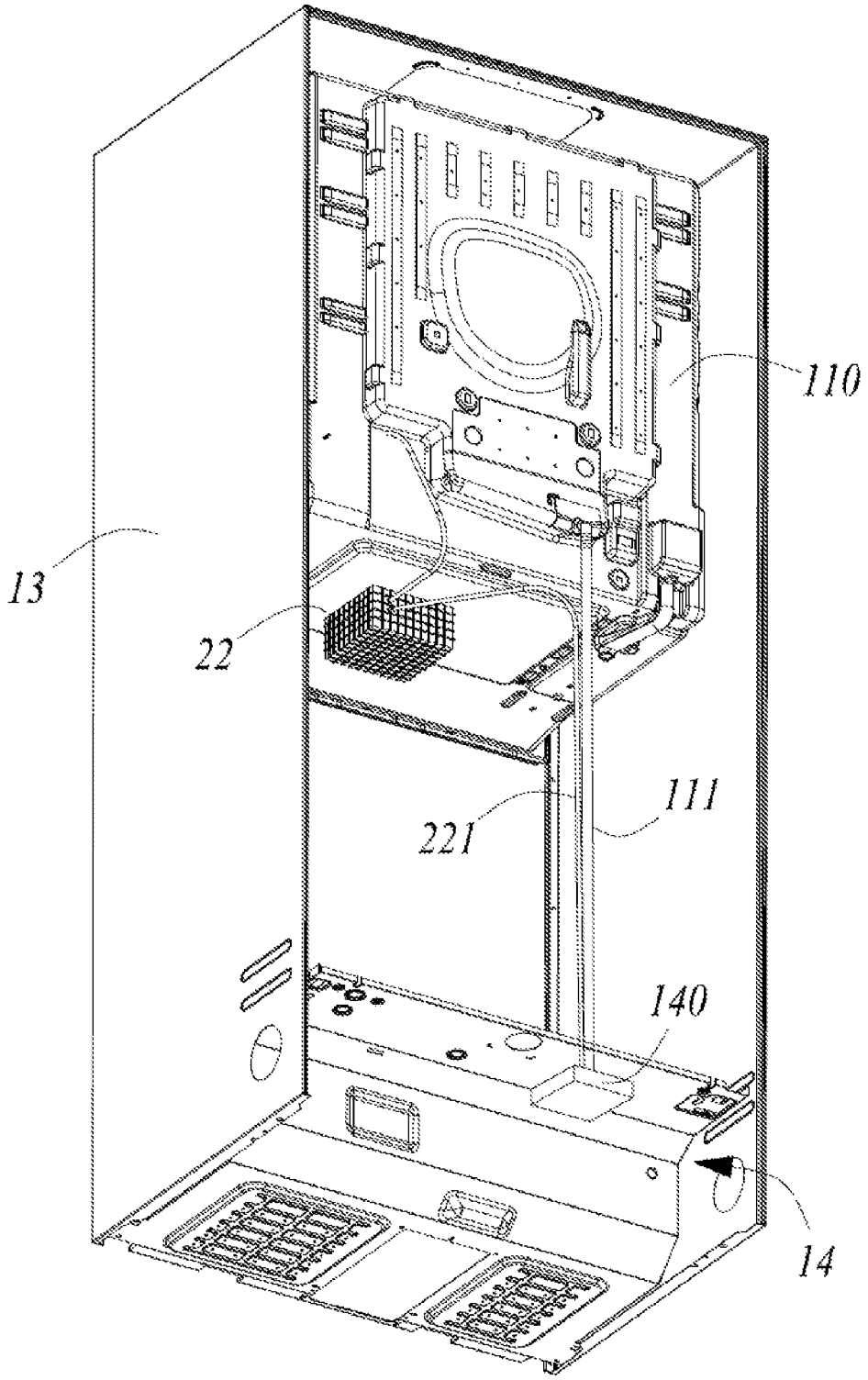
FIG. 2 shows a schematic diagram of the refrigerator shown in FIG. 1 at a second angle with a rear housing, a freezing liner and a thermal insulation layer removed.

FIGS. 1 and 2 show schematic diagrams of a three-dimensional structure of a refrigerator according to the present invention at two different angles, and the refrigerator according to the present invention has an oxygen-control freshness preservation function.

Specifically, the refrigerator with the oxygen-control freshness preservation function includes a cabinet 100, the cabinet 100 has a refrigerating compartment 11 and a freezing compartment 12 formed therein and is provided therein with a partition plate 15 for separating the refrigerating compartment 11 from the freezing compartment 12. Specifically, the refrigerating compartment 11 is defined by a refrigerating liner 110, and the freezing compartment 12 is defined by a freezing liner 120. In the present embodiment, the cabinet 100 successively includes the refrigerating compartment 11 and the freezing compartment 12 from top to bottom, and the partition plate 15 is formed by a bottom wall of the refrigerating liner 110 and a top wall of the freezing liner 120. In other embodiments of the present invention, the refrigerating compartment 11 and the freezing compartment 12 may also be provided left and right, which is not described in detail here.

Figure 3:
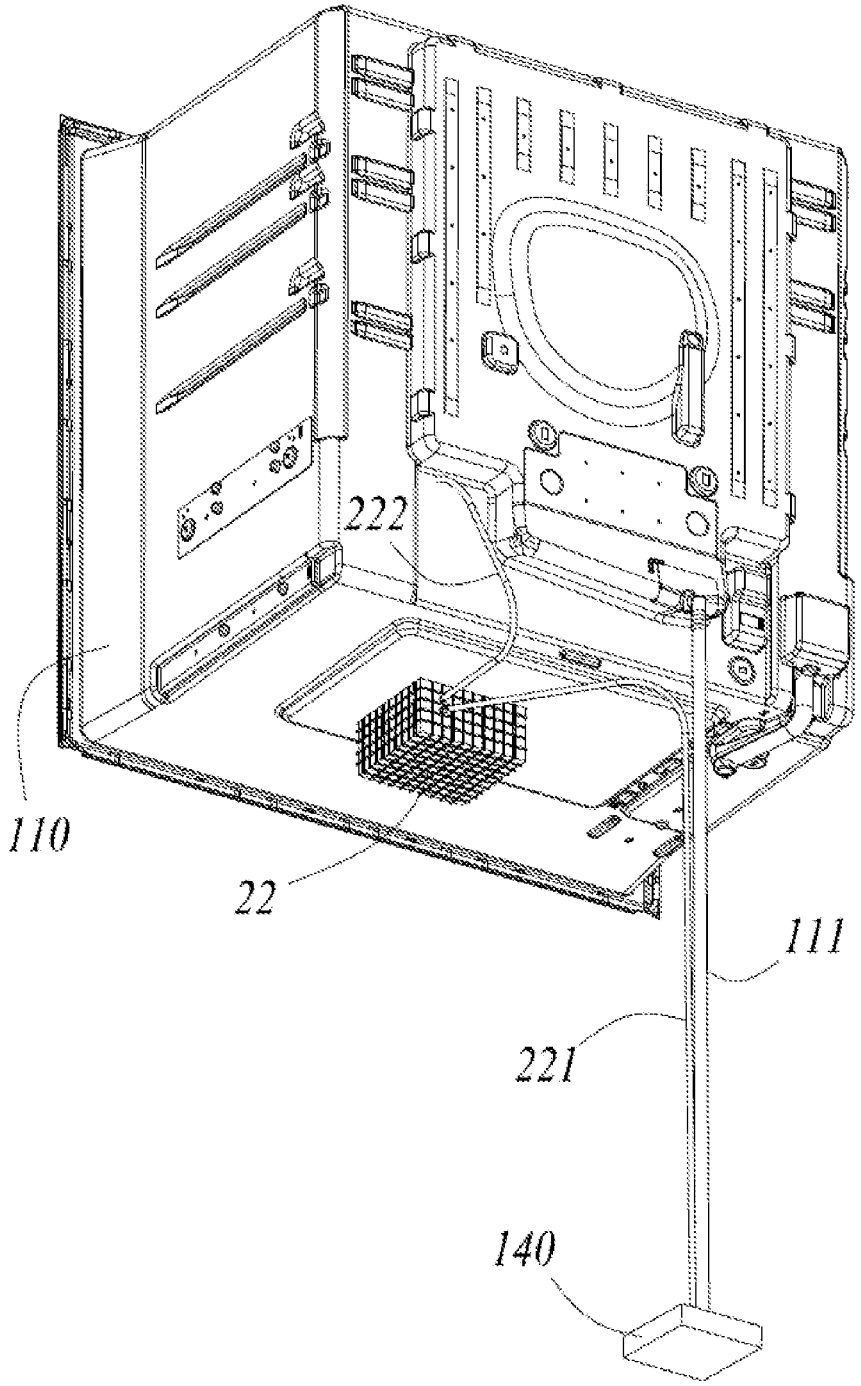
FIG. 3 shows a schematic diagram in which a refrigerating liner, a gas extraction assembly, a drainage pipe and an evaporating pan are fitted.
Figure 4:
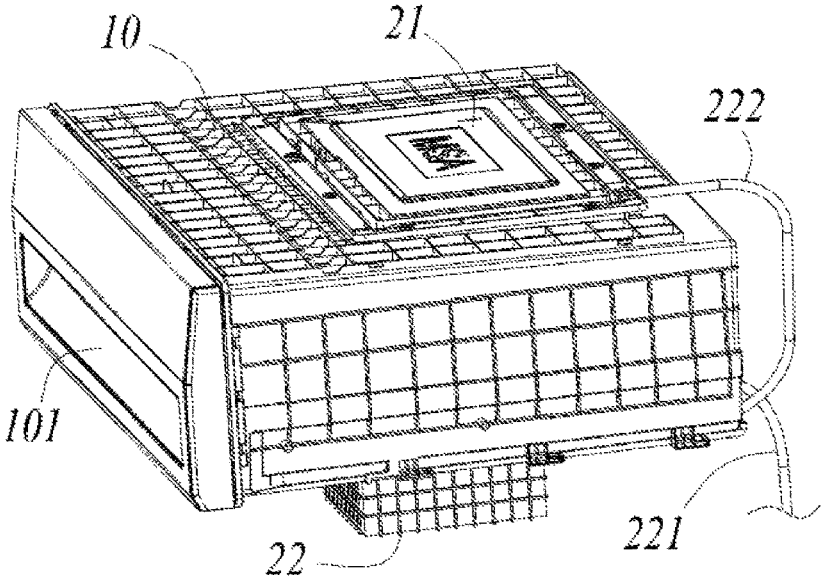
FIG. 4 shows a schematic diagram in which a freshness preservation compartment and the gas extraction assembly are fitted.
Figure 5:
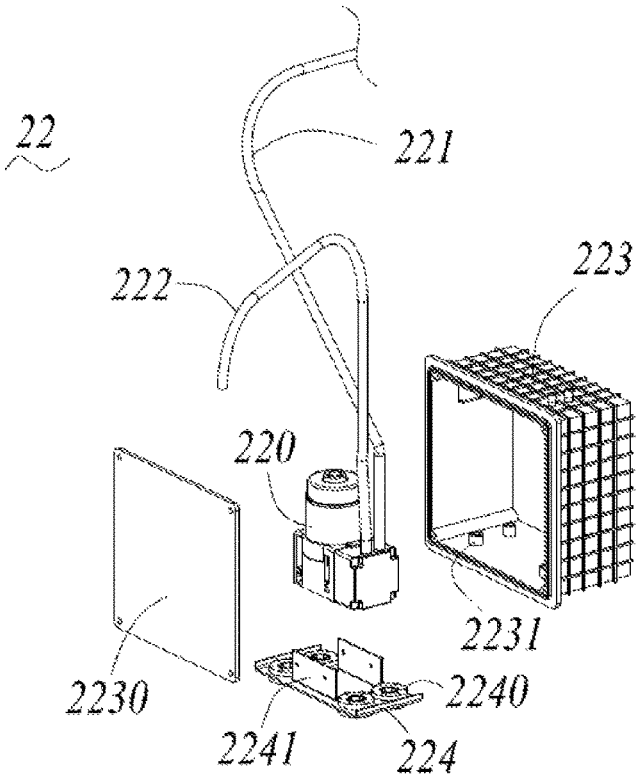
FIG. 5 shows a schematic exploded diagram of the gas extraction assembly.

Referring to FIG. 1, the refrigerator according to the present invention further has a freshness preservation compartment 10 provided in the refrigerating compartment 11 and an oxygen control device for reducing an oxygen content in the freshness preservation compartment 10. As shown in FIGS. 3-5, the oxygen control device includes a gas-regulating membrane assembly 21 and a gas extraction assembly 22.

In an implementation, the gas-regulating membrane assembly 21 has at least one controlled atmosphere membrane (not shown) permeating gas selectively, and the controlled atmosphere membrane has an air inflow side (not shown) coming into contact with air in the freshness preservation compartment 10 and an air outgoing side (not shown) opposite to the air inflow side. It may be understood that two sides of the controlled atmosphere membrane, formed as the air inflow side and the air outgoing side respectively, are separated by the controlled atmosphere membrane spatially; when the air in the freshness preservation compartment 10 enters the air outgoing side from the air inflow side of the controlled atmosphere membrane, an oxygen-nitrogen content ratio of the gas entering the air outgoing side is greater than the oxygen-nitrogen content ratio of the gas in the freshness preservation compartment 10.

In the present invention, the gas extraction assembly 22 constituting the oxygen control device is provided outside the freshness preservation compartment 10 and has a gas extraction pump 220, and the gas extraction pump 220 has a gas intake pipe 222 communicated with the air outgoing side of the controlled atmosphere membrane and a gas discharge pipe 221 for exhausting the gas at the air outgoing side of the controlled atmosphere membrane.

In the present invention, when the gas extraction pump 220 runs, a negative pressure less than a pressure of the air inflow side (i.e., the freshness preservation compartment 10 side) of the controlled atmosphere membrane may be formed at the air outgoing side thereof communicated with the gas intake pipe 222, such that the gas in the freshness preservation compartment 10 enters the air outgoing side of the controlled atmosphere membrane; due to properties of the controlled atmosphere membrane, oxygen passes through the controlled atmosphere membrane more easily than nitrogen, such that after the gas extraction pump 220 runs for a period of time, an oxygen content of the air in the freshness preservation compartment 10 is lower than an oxygen content of normal air. That is, an atmosphere rich in nitrogen and deficient in oxygen to facilitate freshness preservation of foods may be formed in the freshness preservation compartment 10.

With the refrigerator according to the present invention, the atmosphere rich in nitrogen and deficient in oxygen to facilitate the freshness preservation of the foods may be formed in the freshness preservation compartment 10. In the atmosphere, an intensity of aerobic respiration of fruits and vegetables is reduced by decreasing the content of the oxygen in a fruit-vegetable preservation space, and meanwhile, a basic respiration action is guaranteed to prevent anaerobic respiration of the fruits and vegetables, thereby achieving an aim of long-term preservation of the fruits and vegetables. Further, the atmosphere also has a large amount of gas, such as the nitrogen, or the like, and an efficiency of refrigerating an object in a controlled-atmosphere freshness preservation space is not reduced, such that the fruits and vegetables may be stored effectively.

Furthermore, in the refrigerator according to the present invention, a gas extraction pump 220 is provided in the partition plate 15, separation of the gas extraction pump 220 from the compressor effectively solves a problem of a running resonance in an existing design, and may reduce a running noise of the refrigerator. And when the refrigerator runs, a low temperature environment may be maintained in the partition plate 15 provided between the freezing compartment 12 and the refrigerating compartment 15, thus prolonging a service life of the gas extraction pump 220 and optimizing a running performance thereof.

Referring to FIG. 2, in the present embodiment, the cabinet 100 has a compressor compartment 14 formed at a bottom, for mounting a compressor, and a gas discharge pipe 221 extends into the compressor compartment 14 to cool the compressor, which may prolong a service life of the compressor and optimize a running performance thereof.

Further, as shown in FIGS. 2 and 3, an evaporating pan 140 is provided in the compressor bin 14, and the refrigerator further has a drainage pipe 111 connected with the refrigerating liner 110 to drain liquid water therein into the evaporating pan 140. Usually, an evaporator, provided in the refrigerating liner 110, is required to be defrosted when the refrigerator runs, and defrosting water is drained to the evaporating pan 140 through the drainage pipe 111. In the present embodiment, the gas discharge pipe 221 connected with the gas extraction pump 220 approaches the drainage pipe 111 from the gas extraction pump 220 and extends into the compressor bin 14 through the drainage pipe 111. Based on the arrangement, when the refrigerator is assembled, the drainage pipe 111 may be fixed synchronously with the gas discharge pipe 221, thereby simplifying a manufacturing process of the refrigerator and decreasing a number of fixing pieces for fixing the drainage pipe 111 and the gas discharge pipe 221, thus improving an efficiency of assembling the refrigerator and reducing a manufacturing cost thereof.

In an implementation, an air outlet of the gas discharge pipe 221 extends right above the evaporating pan 140. Considering that a certain amount of moisture is present in the gas sucked by the gas extraction pump 220, the extension of the air outlet of the gas discharge pipe 221 right above the evaporating pan 140 avoids unnecessary damages due to a water drop formed in the gas discharge pipe 221 dripping into the compressor bin 14.

In the present invention, a casing 13 is further provided outside the refrigerating liner 110 and the freezing liner 120, a thermal insulation layer (not shown) is formed among the refrigerating liner 110, the freezing liner 120 and the casing 13. The partition plate 15 is also provided therein with a thermal insulation layer (not shown) made of a thermal insulation material, and a suction assembly 22 is provided in the thermal insulation layer of the partition plate 15.

Furthermore, in the present embodiment, usually, the gas discharge pipe 221 and the drainage pipe 111 mentioned above, both provided in the thermal insulation layer, are fixed in place before foam formation of the thermal insulation layer.

In the present embodiment, as shown in FIGS. 1 and 2, the refrigerating compartment 11 is located right above the freezing compartment 12, the freshness preservation compartment 10 is provided at a bottom of the refrigerating compartment 11, and the gas extraction pump 220 is provided at a center of the partition plate 15. As such, a vibration and a noise caused when the gas extraction pump 220 runs may be cancelled in the cabinet 100 as much as possible, and can shorten a length of the gas intake pipe 222 between the gas extraction pump 220 and the gas-regulating membrane assembly 21, and reduce a vacuum loss of the gas-regulating membrane assembly 21.

Figure 6:
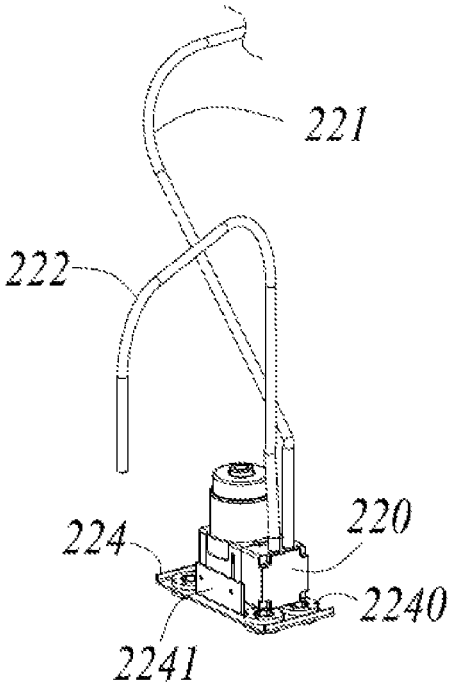
FIG. 6 shows a schematic diagram in which the gas extraction pump and a mounting rack are fitted.

As shown in FIGS. 5 and 6, the gas extraction assembly 22 in the present embodiment further has an accommodating box 223 mounted at the rear wall of the refrigerating liner 110 and a mounting rack 224 connected with the gas extraction pump 220 and mounted in the accommodating box 223 by a plurality of shock-absorption cushion blocks 2240. Specifically, a pair of clamp plates 2241 for fixing the gas extraction pump 220 are formed at the mounting rack oppositely, and the gas extraction pump 220 is clamped between the two clamp plates 2241 and fixed by a screw or a buckle; a plurality of mounting portions 2231 for being fixedly fitted with the plural shock-absorption cushion blocks 2240 are formed at an inner wall of the accommodating box 223; a side wall of the accommodating box 223 is further provided with a through hole for the gas discharge pipe 221 and the gas intake pipe 222 to pass through, and an opening for placing the gas extraction pump 220, formed at a side of the accommodating box 223, is covered with a cover plate 2230. Based on this implementation, the gas extraction pump 220 may be fixed in the accommodating box 223 relatively stably, and the running vibration of the gas extraction pump 220 may be reduced effectively.

As shown in FIGS. 1 and 4, in the present embodiment, the freshness preservation compartment 10 has a drawer 101 able to slide in and out. In other embodiments of the present invention, the freshness preservation compartment 10 may only be provided with a door for opening and closing the freshness preservation compartment 10, dispensing with the drawer 101.

Referring to FIG. 4, the gas-regulating membrane assembly 21 is provided outside a top wall of the freshness preservation compartment 10, and it may be understood that in order to ensure that the air in the freshness preservation compartment 10 comes into contact with the air inflow side of the controlled atmosphere membrane, an opening (not shown) is provided outside the top wall of the freshness preservation compartment 10 for the air therein to come into contact with the air inflow side of the controlled atmosphere membrane. Furthermore, as an implementation of the present embodiment, the gas intake pipe 222 passes through a rear wall of the refrigerating compartment 110 (i.e., a rear wall of the refrigerating liner 11) to connect the gas extraction pump 220 with a controlled atmosphere membrane assembly 21.

In an implementation, a plurality of microholes may be formed at a side wall of the freshness preservation compartment 10, and an internal space of the refrigerating compartment 11 is communicated with an internal space of the freshness preservation compartment 10 through the plurality of microholes. The microhole serves as an air pressure balancing hole, and each microhole may be configured as a millimeter-level microhole, for example, has a diameter of 0.1 mm to 3 mm, preferably 1 mm, 1.5 mm, or the like. The arrangement of the plural microholes may keep a pressure in the freshness preservation compartment 10 from being too low, and also prevent the nitrogen in the space of the freshness preservation compartment from flowing to a large storage space 211. The flow, if any, does not affect preservation of the foods in the freshness preservation compartment 10. In some optional embodiments of the present invention, the side wall of the freshness preservation compartment 10 may also not be provided with the microhole, and a pressure is balanced by a gap between the drawer 101 and the side wall of the freshness preservation compartment 10.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

So far, a person skilled in the art shall know that although a plurality of exemplary embodiments of the present invention have been described above in detail, various variations and improvements can be directly determined or deducted from the content disclosed by the present invention without departing from the spirit and scope of the present invention. Therefore, all those variations and improvements shall be deemed to be covered by the scope of the present invention.

What is claimed is:

1. An oxygen-control freshness preservation refrigerator, comprising a cabinet having a refrigerating compartment and a freezing compartment formed therein, the cabinet being provided therein with a partition plate for separating the refrigerating compartment from the freezing compartment, wherein the refrigerator further has a freshness preservation compartment provided in the refrigerating compartment and an oxygen control device for reducing an oxygen content in the freshness preservation compartment, and the oxygen control device comprises a controlled atmosphere membrane assembly and a suction assembly; the controlled atmosphere membrane assembly has at least one controlled atmosphere membrane permeating gas selectively, the controlled atmosphere membrane has an air inflow side coming into contact with air in the freshness preservation compartment and an air outgoing side opposite to the air inflow side, and the controlled atmosphere membrane assembly is configured to enable an oxygen-to-nitrogen content ratio of gas entering the air outgoing side from the air inflow side to be greater than an oxygen-to-nitrogen content ratio of gas in the freshness preservation compartment; the suction assembly has a gas extraction pump provided in the partition plate, and the gas extraction pump has a gas intake pipe communicated with the air outgoing side of the controlled atmosphere membrane and a gas discharge pipe for exhausting the gas at the air outgoing side of the controlled atmosphere membrane.

2. The oxygen-control freshness preservation refrigerator according to claim 1, wherein the cabinet has a compressor compartment formed at a bottom, for mounting a compressor, and the gas discharge pipe extends into the compressor compartment to cool the compressor.

3. The oxygen-control freshness preservation refrigerator according to claim 2, wherein an evaporating pan is provided in the compressor compartment, the refrigerator further has a drainage pipe connected with a refrigerating liner to drain liquid water therein into the evaporating pan, and the gas discharge pipe approaches the drainage pipe from the gas extraction pump and extends into the compressor compartment through the drainage pipe.

4. The oxygen-control freshness preservation refrigerator according to claim 3, wherein an air outlet of the gas discharge pipe extends right above the evaporating pan.

5. The oxygen-control freshness preservation refrigerator according to claim 2, wherein a thermal insulation layer is formed in the partition plate, and the suction assembly is provided in the thermal insulation layer.

6. The oxygen-control freshness preservation refrigerator according to claim 5, wherein the refrigerating compartment is located right above the freezing compartment, the freshness preservation compartment is provided at a bottom of the refrigerating compartment, and the gas extraction pump is provided at a center of the partition plate.

7. The oxygen-control freshness preservation refrigerator according to claim 6, wherein the suction assembly further has an accommodating box mounted at a rear wall of the refrigerating liner and a mounting rack connected with the gas extraction pump and mounted in the accommodating box by a plurality of shock-absorption cushion blocks.

8. The oxygen-control freshness preservation refrigerator according to claim 1, wherein the freshness preservation compartment has a drawer able to slide in and out.

9. The oxygen-control freshness preservation refrigerator according to claim 7, wherein the controlled atmosphere membrane assembly is provided outside a top wall of the freshness preservation compartment, and an opening is provided outside the top wall of the freshness preservation compartment for the air therein to come into contact with an air inflow side of the controlled atmosphere membrane.

10. The oxygen-control freshness preservation refrigerator according to claim 9, wherein the gas intake pipe passes through a rear wall of the refrigerating compartment to connect the gas extraction pump with the controlled atmosphere membrane assembly.

* * * * *